United States Patent [19]

King

[11] 4,250,728

[45] Feb. 17, 1981

[54] APPARATUS AND METHOD FOR FORMING STEPS IN PROFILED SHEETS OF MATERIAL

[76] Inventor: Eric G. King, Flat 1, 31 Carnot St., Rotorua, New Zealand

[21] Appl. No.: 902,707

[22] Filed: May 4, 1978

[51] Int. Cl.³ ..... B21D 11/18

[52] U.S. Cl. ..... 72/177; 72/184; 72/385; 428/603; 113/116 Y

[58] Field of Search ..... 113/116 A, 116 F, 116 Y, 113/116 Z; 72/384, 385, 184, 185, 177, 368; 52/630; 428/603, 604; 264/287

[56] References Cited

U.S. PATENT DOCUMENTS

| | | | |
|---|---|---|---|
| 2,901,951 | 9/1959 | Hochfeld | 264/287 |
| 3,938,244 | 2/1976 | Merle | 72/368 |
| 4,052,948 | 10/1977 | Straza et al. | 72/385 |

FOREIGN PATENT DOCUMENTS

| | | | |
|---|---|---|---|
| 874127 | 8/1961 | United Kingdom | 428/603 |

*Primary Examiner*—Lowell A. Larson
*Attorney, Agent, or Firm*—John S. Roberts, Jr.

[57] ABSTRACT

Two pairs of dies are arranged adjacent each other so that each pair can clamp onto a metal sheet between them. One pair is situated slightly below, or stepped down from, the other pair. One pair of dies clamps onto the sheet, and then the other pair is clamped onto it to bend the sheet so that a step is formed in the sheet between the two pairs of dies, corresponding to the step down from one pair of dies to the other.

18 Claims, 10 Drawing Figures

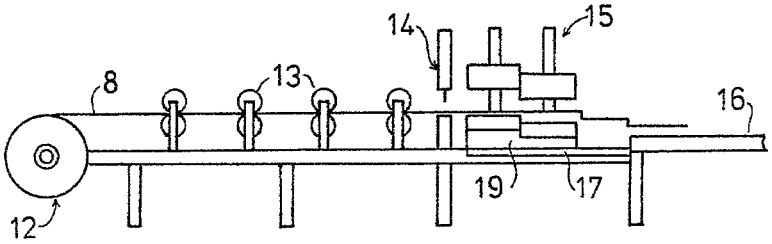
FIG 6
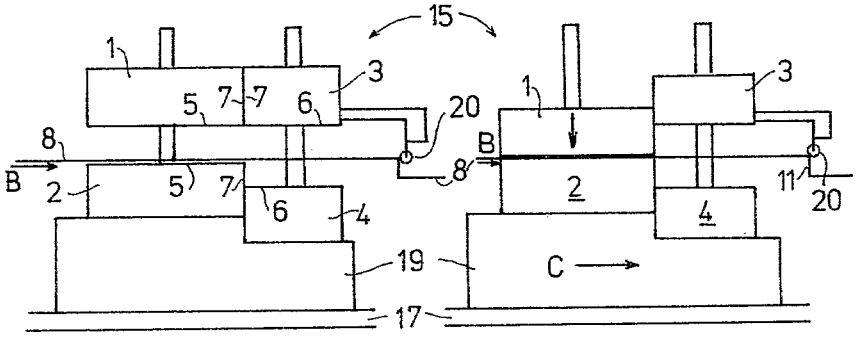
FIG 7
FIG 8
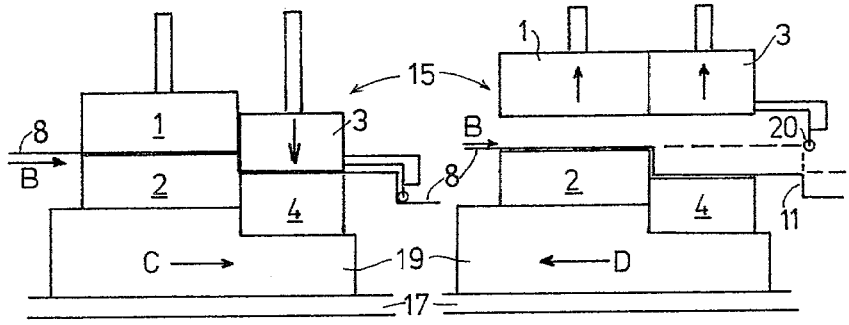
FIG 9
FIG 10

APPARATUS AND METHOD FOR FORMING STEPS IN PROFILED SHEETS OF MATERIAL

BACKGROUND OF THE INVENTION

This invention relates to an apparatus and method for forming steps or bends in profiled sheets of material. The invention has been designed particularly for forming steps in sheets of metal and especially long-run roofing iron, for use in roofing applications. The steps formed in the roofing iron give the impression of a tile-like formation in the completed roof. However, it should be realised that the invention can be adapted for use with other materials for use in this and other applications.

While there is little difficulty in bending or forming steps in flat sheets of metal or other materials a problem arises in bending or forming steps across a profiled sheet of material which is three dimensional rather than two dimensional and the resulting bend or bends can be distorted by deformation of the material or alternatively tearing of the material can occur. It was with these problems in mind that the present invention was devised.

SUMMARY OF THE INVENTION

In one aspect the present invention consists in an apparatus for forming a step in a profiled sheet of material where the step is formed across the profile of the sheet, the apparatus comprising a first die and a second die which together provide a first pair of opposing dies, and a third die and a fourth die which together provide a second pair of opposing dies, the second pair of dies being located adjacent the first pair of dies and positioned so that a step is provided between the second die and the fourth die, the first die and the third die being separately movable towards and away from the second die and the fourth die respectively, the dies of each pair having on the opposing faces a profile corresponding to the profile of the sheet of material, and those adjacent faces of the dies forming the step in use having a profile which is the inverse of the profile of the sheet of material.

In a second aspect the present invention consists in a method of forming a step in a profiled sheet of material where the step is formed across the profile of the sheet, the method comprising the steps of placing a profiled sheet between a first die and second die, which together provide a first pair of opposing dies, and between a third die and a fourth die, which together provide a second pair of opposing dies, the second pair of dies being located adjacent the first pair of dies and positioned so that there is a step between the second die and the fourth die, the opposing faces of each pair of dies having a profile corresponding to the profile of the sheet, closing the first die against the second die to clamp the sheet between their opposing faces and then closing the third die against the fourth die to clamp the sheet between their opposing faces, this latter operation forming a step in the sheet which is given a profile the inverse of the profile of the rest of the sheet by the action of the adjacent face of the third die moving over the adjacent face of the fourth die, both of these adjacent faces having a profile which is the inverse of the profile of the sheet of material, the dies of each pair then being separated.

In a third aspect the present invention consists in a profiled sheet of material having a step or bend formed across the profile of the sheet, said step or bend having a profile which is the inverse of the profile of the rest of the sheet.

BRIEF DESCRIPTION OF THE DRAWINGS

FIG. 6 shows in diagrammatic form an elevation of a preferred apparatus for continuously forming steps in a continuously moving sheet of material, and FIGS. 7–10 show in diagrammatic form the sequence of movements performed by the dies during the step or tile forming operation.

DESCRIPTION OF THE PREFERRED EMBODIMENT

Figure 1:
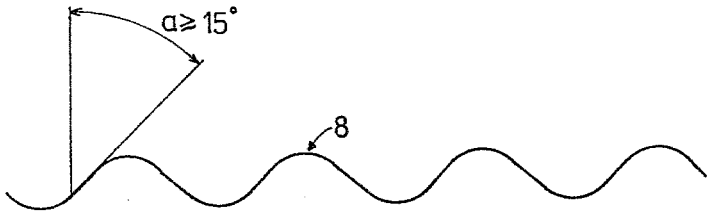
FIG. 1 is a cross section on I—I of FIG. 5 showing the corrugated or substantially sinusoidal profile of the preferred sheet of material.

According to the present invention an apparatus and a method are provided for forming steps in a profiled sheet of material. The material will usually be a metal and in particular will usually be a long run iron sheet such as used in roofing. Commonly roofing iron has a corrugated or substantially sinusoidal profile as illustrated in the drawings and by use of the invention a plurality of steps can be formed in the iron sheet at intervals along its length, these steps being formed across the profile of the sheet. As has been previously explained the profiled sheet is in fact three dimensional and because of this great care must be taken in the step forming operation and dies appropriate to the forming operation and the particular profile of the sheet of material must be used.

Figure 4:
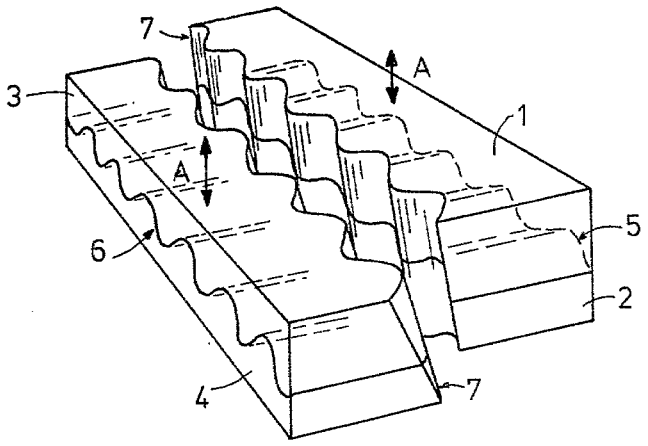
FIG. 4 is a diagrammatic perspective view of the dies used in forming the step on the sheet of material.
Figure 5:
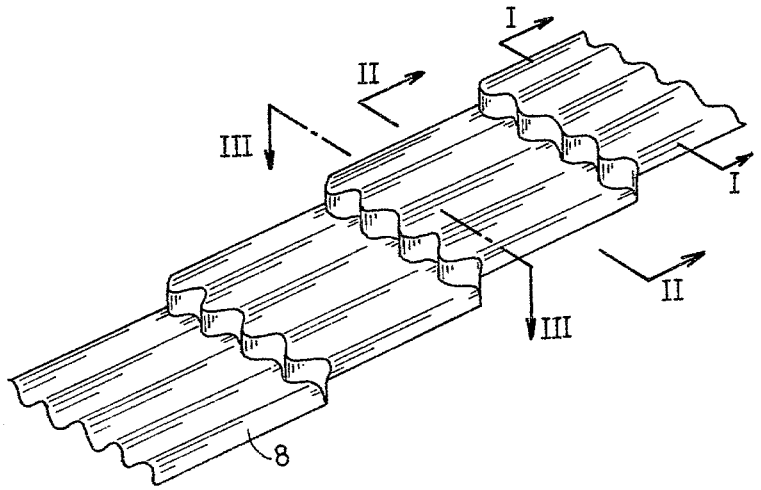
FIG. 5 is a perspective view of the preferred sheet of material having a corrugated or substantially sinusoidal profile in which a plurality of steps have been formed.

The basic apparatus of the invention comprises four dies, there being a first die 1 and a second die 2 which together form a first pair of opposing dies, and a third die 3 and a fourth die 4 which together form a second pair of opposing dies. As shown in FIG. 4 and in FIGS. 6–10 the two pairs of dies are placed adjacent each other with the second and fourth dies being positioned relative to each other so there is a step between them. During a step forming operation these two dies 2 and 4 are fixed relative to each other and in fact could be formed from the one die block but it is preferred that they are separate and adjustable relative to each other so that the depth of the step can be adjusted. The first die and the third die are movable towards and away from the second and fourth dies respectively as indicated by the arrows A in FIG. 4. The movement of the first and third dies will not normally coincide though the movements will usually be related.

Each die has on its face opposing the other die of the pair, a profile corresponding to the profile of the sheet of materials 8. The opposing faces of the first pair of dies are indicated by the number 5 and the opposing faces of the second pair of dies are indicated by the number 6. In FIG. 4 the profile shown is substantially sinusoidal for use with the usual corrugated sheets or roofing iron the cross-sectional profile of which is shown in FIG. 1.

Figure 2:
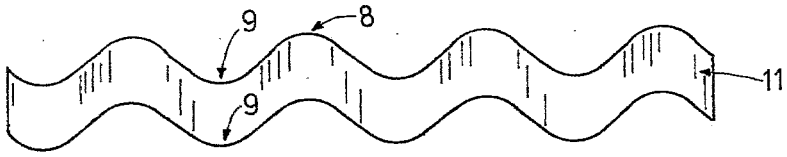
FIG. 2 is a view on II—II of FIG. 5 showing an elevation of a step formed in the sheet of material.
Figure 3:
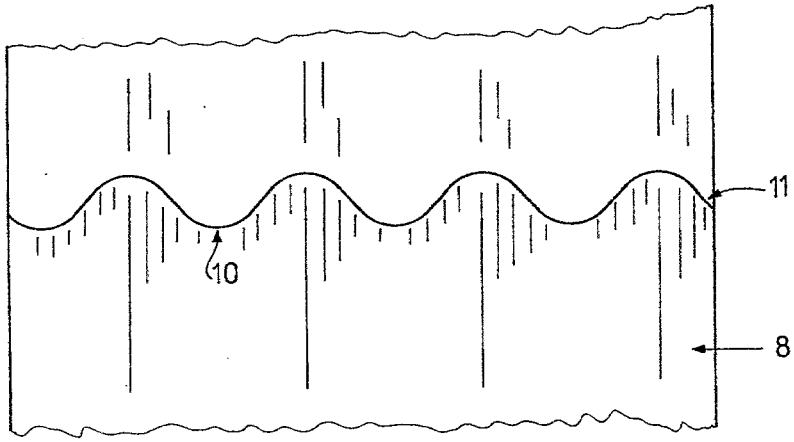
FIG. 3 is a view of III—III of FIG. 5 looking down on the step formed in the sheet of material.

Those faces of the dies forming the step in use, that is, the adjacent faces 7 between the adjacent pairs of dies, are also profiled but this profile is the inverse of the profile of the sheet of the material and of the profile on the faces 5 and 6 of the dies. This feature is illustrated in FIG. 4 but is perhaps more clearly shown on the formed sheet of material shown in FIGS. 2 and 3. From these two Figures it can be seen that a dip 9 in the profile of the sheet of material 8 corresponds to a peak 10 in the step 11 formed in the sheet of material. Only the adjacent faces of the second and the third dies need be profiled as it is the movement of the adjacent face of the third die over the adjacent face of the second die which forms the profiled step but usually the adjacent faces of the four dies will be profiled.

While most sheets of long-run roofing iron have a substantially sinusoidal corrugated profile the invention can be adapted for use with sheets of material having other profiles. However, because of the deformation of the material in a step during the formation of the step it has been found that in practice the angle between a normal to the plane of the sheet of material and a tangent to the profile be substantially equal to or greater than 15° and less than 90°, this angle being the angle 'a' shown in FIG. 1. Obviously if the angle 'a' was 90° to all parts of the profile the sheet of material would be a flat sheet.

In practice, the step forming operation is performed by raising the first die and also raising the third die clear of the step to allow a suitable profiled sheet of material to be placed between the dies of each pair and the first die is lowered to clamp the sheet of material between the first and second dies. The third die is then lowered against the fourth die to form the step in the sheet of material. To reduce undesirable deformation of the sheet of material during the forming operation it is important to fold across the profile all at the same time, the die 3 as it descends contacting the profiled sheet of material at all points across its width at the same time. It is a feature of the invention that by first closing together the first pair of dies and then the second pair of dies there is no drawing of the metal except at the bend lines. Once the step has been formed in the sheet of material the first and third dies are then raised to allow the sheet of material to be re-positioned for the stamping of a second step or to remove the sheet from between the dies. The sequence of operations described above is illustrated in FIGS. 7–10.

The dies can be operated in a static hydraulic or pneumatic press in which case the sheet of material is held stationary while either pair of dies is clamped against the sheet. Alternatively the apparatus can be adapted for a continuous forming operation as will now be described with particular reference to FIGS. 6–10 of the accompanying drawings. For a continuous operation a sheet of roofing iron or other material will usually be provided in the form of a roll. In FIG. 6 the sheet of metal 8 supplied in roll form is fed from a de-coiler 12 through a series of roll formers 13. These roll formers are driven and impart motion to the sheet of metal and usually the roll formers will also be used to form the desired profile across the width of the sheet of metal. In this manner the sheet of metal can be corrugated, for example, as is usual. A guillotine 14 is preferably provided after the roll formers and before or after the dies to cut the sheet of metal to required lengths. The sheet of metal is then fed between the upper and lower dies of die block assembly 15 which perform the tile forming operation, after which the sheet of metal is fed to a run off table 16 or the like. The die block assembly 15 has a base 19 which is mounted on and is movable along a track 17 so that the die block assembly can be reciprocated back and forth. The preferred die block assembly as shown in FIGS. 7–10 comprises the base 19 which carries two lower dies 2 and 4. Die 4 is stepped down with respect to die 2, it being this step which is to be stamped into the sheet of metal to give the stepped tile pattern. Positioned above the lower dies are the two upper dies 1 and 2 respectively.

In FIG. 7 the long-run sheet of metal 8 is moving to the right as shown by arrow B. When this contacts a limit switch 20 a ram (not shown) which may be hydraulic or pneumatic or a combination of both is activated to close die 1 against die 2, thus clamping the sheet of metal between these two dies, as is shown in FIG. 8. At this stage the die block assembly is itself moving to the right (arrow C) on track 7 at the same rate at which the sheet of metal is moving. Die 3 is moved by a second ram (not shown) against die 4 which is fixed to give the depth of step required in relation to die 2. This is shown in FIG. 9. Once the step 11 has been formed die 3 is raised followed by die 1 whereupon die block assembly 15 is moved in direction of arrow D back to its original position, the sheet of metal passing through the gap between the upper and lower dies, ready for the next stamping operation.

Any known and suitable arrangement can be used to cause reciprocation of the die block assembly. One simple arrangement is to have a spring return arrangement so that when die 1 is clamped against die 2 with the sheet of metal between, the movement of the sheet of metal causes the die block assembly to be moved along its sliding track. After the forming operation and on separation of the upper and lower dies, the spring arrangement then causes the die block to slide back to its original position. Suitable de-coiling and roll forming apparatus is already known and it is preferred that the die block assembly be adapted for use with existing machines producing long-run iron roofing in various profiles. A common production rate is about 15 m per minute and if the length of tile (that is the distance between each step 11) is 30 cm, the die block assembly must undergo 50 cycles per minute. It will be apparent from the drawings that the length of the tile is governed by the position of the limit switch 20 which is preferably adjustable in position and that when the die block 3 is raised, the limit switch is clear of the metal sheet and is positioned ready to be contacted by that step last formed, as it moves out from between the dies, the steps being formed at equal intervals.

An advantage of the apparatus shown in FIG. 6 is that there are no limitations on the length of run apart from the total length of the sheet of material in the coil. The roll formers 13 can be run by themselves to form standard long-run stepped and profiled sheets. The effect of putting the step into the profiled sheet of metal provides a three dimensional fold which has very strong resistance to bending. The profiled sheets with the profiled steps allow overlapping at the edges of two or more sheets where weatherproof joints are required.

The invention that has been described has covered the particular case of the formation of a step in a profiled sheet of material. However, in another aspect of the invention the apparatus could be adapted to form a single bend in a profiled sheet of material at an edge of the sheet, the die 4 being lowered sufficiently with respect to die 2 or removed altogether. Furthermore, the bend or step formed in a sheet of material need not be at right angles to the plane of the sheet of material but could be at some other angle, though obviously greater complications occur with bend angles of greater than 90° because of the greater deformation of the material that is involved.

While the usual material that would be used would be a metal sheet other materials such as plastics materials could also be used; the sheet perhaps being suitably heated before the forming operation to allow the bending and deformation of the material to occur.

A feature of the invention is that because drawing of the sheet material is not marked and occurs virtually only at the bend lines the sheet may be pre-painted, and then formed without cracking the coat of paint. Similarly, the galvanised layer on sheets of steel is not damaged to any great extent during the step forming operation.

I claim:

1. An apparatus for forming a step in a profiled sheet of material where the step is formed across the profile of the sheet as the sheet moves through the apparatus, the apparatus comprising a first die and a second die which together provide a first pair of opposing dies, and a third die and a fourth die which together provide a second pair of opposing dies, the second pair of dies being located adjacent the first pair of dies and positioned so that a step is provided between the second die and the fourth die, means moving the first die and the third die towards and away from the second die and the fourth die respectively, and independently of one another, said four dies being mounted for reciprocal movement as a unit on track means, means connected to said unit for reciprocally moving the same at a speed substantially equivalent to that of said sheet and in synchronization with said means moving said first die toward said second die to clamp said sheet therebetween before said means moving said third die toward said fourth die to clamp said sheet therebetween to form said step, and thereafter releasing said first and third die to permit the sheet to pass therethrough, the dies of each pair having on the opposing faces a profile corresponding to the profile of the sheet of material, and those adjacent faces of the dies forming the step in use having a profile which is the inverse of the profile of the sheet of material.

2. An apparatus as claimed in claim 1 wherein the profiles are such that the angle between a line normal to the plane of the sheet of material and the tangent to the profile and hence the angle between a line normal to the plane of a profiled face of a die and the tangent to the profile of the face, is at least 15°.

3. An apparatus as claimed in claim 1 wherein said adjacent face of each of the four dies is profiled.

4. An apparatus as claimed in claim 1 including means wherein the second and the fourth dies are adjustable relative to each other to allow adjustment of the height of the step to be formed in the sheet of material.

5. An apparatus as claimed in claim 1 wherein the apparatus includes de-coiling means before the dies for de-coiling the sheet of material if supplied in roll form, and cutting means for cutting the sheet of material to length, the cutting means being located after the de-coiling means and either before or after the dies.

6. An apparatus as claimed in claim 1 wherein the apparatus includes a control means to automatically control the spacing between the steps formed in a sheet of material.

7. An apparatus as claimed in claim 1 wherein the sheet of material is corrugated, that is, the profile of the sheet of material and hence the profiles of the dies are substantially sinusoidal.

8. A method of forming a step in a profiled sheet of material where the step is formed across the profile of the sheet, the method comprising the steps of moving a profiled sheet between a first die and second die, which together provide a first pair of opposing dies, and between a third die and a fourth die, which together provide a second pair of opposing dies, the second pair of dies being located adjacent the first pair of dies and positioned so that there is a step between the second die and the fourth die, mounting the pair of dies as a unit on track means for reciprocal movement thereon with the dies moving with the sheet with the pairs of dies being sequentially clamped and opened against the sheet and returning when the sheet is released, the opposing faces of each pair of dies having a profile corresponding to the profile of the sheet, closing the first die against the second die to clamp the sheet between their opposing faces and then closing the third die against the fourth die to clamp the sheet between their opposing faces, this latter operation forming a step in the sheet which is given a profile the inverse of the profile of the rest of the sheet by the action of the adjacent face of the third die moving over the adjacent face of the second die, both of those adjacent faces having a profile which is the inverse of the profile of the sheet of material, the dies of each pair then being separated.

9. A method as claimed in claim 8 wherein the sheet of material is provided in roll form and is de-coiled and profiled prior to passing through the dies, the sheet also being cut to length after de-coiling and profiling and either before or after passing through the dies.

10. An apparatus for forming a step across the profile of a substantially sinusoidally corrugated sheet of material, the apparatus comprising a first die and a second die which together provide a first pair of opposing dies, and a third die and a fourth die which together provide a second pair of opposing dies, the second pair of dies being located adjacent the first pair of dies and positioned so that a step is provided between the second die and the fourth die, the first die and the third die being separately movable towards and away from the second die and the fourth die respectively while the second and fourth dies remain stationary, the dies of each pair having on their opposing faces a substantially sinusoidally corrugated profile corresponding to the profile of the sheet of material, and those adjacent faces of the dies which form the step in use having a substantially sinusoidally corrugated profile which is the inverse of the profile of the sheet of material.

11. An apparatus as claimed in claim 10 wherein the profiles are such that the angle between a line normal to the plane of the sheet of material and the tangent to the profile and hence the angle between a line normal to the plane of a profiled face of a die and the tangent to the profile of the face, is at least 15°.

12. An apparatus as claimed in claim 10 wherein said adjacent face of each of the four dies is profiled.

13. An apparatus as claimed in claim 10 wherein the second and the fourth dies are adjustable relative to each other to allow adjustment of the height of the step to be formed in the sheet of material.

14. An apparatus as claimed in claim 10 wherein the apparatus includes de-coiling means before the dies for de-coiling the sheet of material if supplied in roll form, and cutting means for cutting the sheet of material to length, the cutting means being located after the de-coiling means and either before or after the dies.

15. An apparatus as claimed in claim 10 wherein the apparatus includes a control means to automatically control the spacing between the steps formed in a sheet of material.

16. A method of forming a step across the profile of a substantially sinusoidally corrugated sheet of material, the method comprising the steps of placing a corrugated sheet between a first die and a second die which together provide a first pair of opposing dies, and between a third die and a fourth die which together provide a second pair of opposing dies, the second pair of dies being located adjacent the first pair of dies and positioned so that there is a step between the second die and the fourth die, the opposing faces of each pair of dies having a substantially sinusoidally corrugated profile corresponding to that of the sheet, closing the first die against the second die to clamp the sheet between their opposing faces and then closing the third die against the fourth die to clamp the sheet between their opposing faces, the second and fourth dies remaining stationary, this latter operation forming a step in the sheet which is given a profile the inverse of the profile of the rest of the sheet by the action of the adjacent face of the third die moving over the adjacent face of the second die, both of those adjacent faces having a profile which is the inverse of the original profile of the sheet of material, the dies of each pair being then separated.

17. A method as claimed in claim 16 wherein the sheet of material is continuously moving and the dies are reciprocated back and forth along a track, the dies moving with the sheet while the one or both pairs of dies are clamped against the sheet and returning when the sheet is released.

18. A method as claimed in claim 16 wherein the sheet of material is provided in roll form and is de-coiled and profiled prior to passing through the dies, the sheet also being cut to length after de-coiling and profiling and either before or after passing through the dies.

* * * * *